United States Patent [19]

Love et al.

[11] Patent Number: 4,745,977

[45] Date of Patent: May 24, 1988

[54] METHOD FOR RESISTING CORROSION IN GEOTHERMAL FLUID HANDLING SYSTEMS

[75] Inventors: William W. Love, La Habra Heights; Carl J. Cron, Placentia, both of Calif.

[73] Assignee: Union Oil Company of California, Los Angeles, Calif.

[21] Appl. No.: 722,785

[22] Filed: Apr. 12, 1985

[51] Int. Cl.[4] ..... E21B 43/00; C22F 1/18

[52] U.S. Cl. ..... 166/369; 148/407; 166/902; 420/420

[58] Field of Search ..... 148/407, 421; 420/420, 420/421; 166/303, 369, 902

[56] References Cited

U.S. PATENT DOCUMENTS

| | | | |
|---|---|---|---|
| Re. 27,286 | 2/1972 | Bertea et al. | 420/421 |
| 2,906,654 | 9/1959 | Abkowitz | 148/407 |
| 3,510,295 | 5/1970 | Cox et al. | 148/407 |
| 3,615,378 | 10/1971 | Bomberger, Jr. et al. | 420/420 |
| 3,802,877 | 4/1974 | Parris et al. | 420/420 |
| 4,057,108 | 11/1977 | Broussard | 166/902 |
| 4,299,626 | 11/1981 | Paton et al. | 420/420 |

FOREIGN PATENT DOCUMENTS

| | | | |
|---|---|---|---|
| 621914 | 6/1961 | Canada | 420/420 |
| 1179007 | 10/1964 | Fed. Rep. of Germany | 420/420 |
| 147114 | 11/1979 | Japan | 420/421 |

OTHER PUBLICATIONS

"Performance and Application of Titanium Alloys in Geothermal Brine Service", R. W. Schutz, Materials Performance, Jan. 1985, 39–47.

New Markets Being Explored for Titanium Alloy, Barbara Weiss, American Metals Market, Sep. 1984.

Corrosion of Selected Metals and a High Temperature Thermoplastic in a Hypersaline Geothermal Brine, Bureau of Mines Report, No. RI 8792, 1983.

The Influence of Surface Condition and Environment on the Hydriding of Titanium, Corrosion-Nace, vol. 35, No. 8, Aug. 1979, pp. 378–382.

"Titanium, Past, Present and Future", Report of the Panel on the Assessment of Titanium, National Materials Advisory Board Publication No. NMAB-392, National Academy Press, Washington, D.C., pp. 120–122.

"Effect of Oxide Films on the Corrosion Resistance of Titanium", by R. W. Schutz and L. C. Covington, Corrosion-Nace, vol. 37, No. 10, Oct. 1981, pp. 585–590.

"Application of Surface Air Oxidizing to Prevent Hydrogen Embrittlement of Titanium in the Chemical Plant", by Toshio Fukuzuka et al., Industrial Applications of Titanium and Zirconium, pp. 71–84, (no further identification of date).

*Titanium Metals Corporation of America v. Banner*, 227 USPQ 773, (CAFC, Nov. 7, 1985.).

*Titanium Metals Corporation of America v. Mossinghof*, 225 USPQ 673, (Dist. Ct. D.C., Nov. 28, 1984).

"Investigation of the Mechanical Properties of Ti-Mo-Ni Alloys", by S. V. Kalabukhova et al., Russian Metallurgy, (Metally), No. 3, pp. 130–133, 1970.

Technical Brocure, "Basic Desigh Facts About Titanium": RMI Company, Niles, Ohio, (pp. 1–15, 29, 30 and 35).

"Guidelines for Selection of Materials for $H_2S$ Services", Battelle Institute, Report to Subscribers, pp. 4, 11, 20, 24 & preface.

*Primary Examiner*—L. Dewayne Rutledge
*Assistant Examiner*—Robert L. McDowell
*Attorney, Agent, or Firm*—Howard R. Lambert; G. F. Wirzbicki; D. Sandford

[57] ABSTRACT

A method for resisting corrosion while conducting a flow of hot corrosive geothermal fluid, particularly brine, comprises flowing the fluid through fluid flow conducting elements, such as production pipe and fittings formed from a metastable beta titanium-base alloy. Preferably the element is formed of a beta and alpha titanium-base alloy formed by heating a particular composition to form a metastable beta titanium matrix and then heat treating the matrix to increase the tensile strength of the matrix by at least about 10,000 psi with a total minimum ultimate tensile strength being about 170,000 psi. The particular composition is comprised essentially of between about 2 and about 10 weight percent of one or more beta eutectoid elements selected from the group consisting of iron, manganese, chromium and cobalt, with weight percentage limits in each such individual element being respectively about 5, about 5.5, about 9 and about 4. The composition also includes about 4 to about 10 weight percent of vanadium, between about 3 to about 6 weight percent of molybdenum, about 2 to about 5 weight percent of aluminum with the remainder of the alloy being titanium. Metastable beta titanium-base alloys comprised of various weight percentage ranges of aluminum, vanadium, chromium, molybdenum and zirconium are also useful in constructing such flow elements.

14 Claims, No Drawings

METHOD FOR RESISTING CORROSION IN GEOTHERMAL FLUID HANDLING SYSTEMS

BACKGROUND OF THE INVENTION

1. Field of the Invention

The present invention relates generally to the geothermal field and more particularly to methods for conducting flows of hot, geothermal brine, water or steam especially such hot geothermal fluids which are highly corrosive in composition.

2. Discussion of the Prior Art

Large, subterranean reservoirs of naturally occuring geothermal steam or water, including brine, exist in many regions of the world. Such geothermal reservoirs are most commonly found in regions of high volcanic, fumarole or geyser activity, as exists along the Pacific Ocean rim, of which California forms a portion.

Because of the typically high temperature, large geothermal steam or water reservoirs typically contain vast amounts of thermal energy. To reduce use of, and dependence on, fossil fuels which can be expected to be eventually depleted, interest exists in the use of geothermal energy for the production of electric power. And, in fact, geothermal steam at The Geysers region of Northern California has, for several years, been used to generate, at competitive rates, at least about two percent of California's electric power requirements. Accordingly, geothermal steam energy at the Geysers displaces daily in excess of about 33,000 barrels of oil, which would be required to generate an equivalent amount of power.

Recently the greatly increased cost of petroleum and the actual or potential disruptions of petroleum supplies from, for example, the Middle East, has caused increased interest in the utilization of geothermal energy to produce power. Although geothermal steam can readily be used to generate electric power, commercially practical sources of geothermal steam are relatively uncommon and most large, accessible sources have already been or are being developed. As a result, substantial effort has been and is being directed to development of economical processes and apparatus for the use of the much more commonly found geothermal water or brine to generate electricity.

General processes whereby geothermal water or brine can be used to generate electric power are, of course, well known. It is known, for example, that geothermal water or brine having a temperature above about 400° F. and a natural pressure of several hundred psig can be flashed to a reduced pressure whereby some of the water or brine is converted into steam. In turn, the steam so produced is used to drive steam turbine-generators. Lower temperature geothermal water or brine can, in contrast, be used in a binary fluid system to vaporize a low boiling point liquid, the gas formed being used to drive gas turbine generators. In some places, geothermal water or brine is, in fact, being used in such manners to generate electric power.

Very often, however, electricity generated by geothermal water or brine, and in particular by geothermal brine, is not cost competitive with electric power generated, for example, by use of fossil fuels. In general, the problems causing the relatively high power generating costs relate to the very large flow rates of geothermal brine required to produce reasonable amounts of power and the chemically complex composition and characteristics of the brine. For example, since a geothermal brine flow rate in excess of one million pounds per hour may be required to produce sufficient steam for generating about 10 megawatts of power, large and hence, expensive, brine handling equipment, including piping, fittings, valves and flashing vessels, is required.

One problem associated with the complex composition of many geothermal brines is the scaling of brine handling equipment by various impurities, such as silica, dissolved into the brine from the underground formations from which the brine is extracted and which precipitate from the brine as brine equilibrium conditions are changed. Considerable costs are, therefore, frequently associated with equipment descaling and/or controlled removal from the brine of scale forming materials so as to reduce equipment scaling.

Another brine composition problem associated with geothermal brine power production (and other brine uses) relates directly to the highly corrosive nature of many geothermal brines, such problems being compounded by the large brine flow rates usually required to produce electric power in commercially useful amounts. The corrosive nature of many geothermal brines (as well as of some geothermal water and steam) is at least partially due to dissolved chlorides and such gases as hydrogen sulfide and carbon dioxide, but is generally rendered much more chemically complex by the brine typically containing many other materials, some of which typically act as buffering agents. These impurities cause many brines to be highly acidic brine pH's of about 4.5 to about 5.5 being common.

Corrosion of down-hole brine handling equipment has been found to be particularly severe and costly in many geothermal brine extraction wells. This is because in such brine production wells, which may typically have depths of 2000 feet to 6000 feet, and especially in lower regions thereof, brine temperatures are higher and pH's are usually lower than in above ground brine handling equipment. An additional problem associated with production well piping is mechanical stresses, at high brine temperatures, principally by the suspended weight of the production pipe. Such stresses can cause mechanical failure of the pipe, especially of pipe that has been weakened by corrosion.

To minimize costs, most geothermal brine production well bores are lined with relatively inexpensive, non-corrosion resistant low-carbon steel pipe. In some regions of the production well bore, there may be several concentric low carbon steel liners, the inner liners extending to progressively greater depths. Thus, in the wellhead region there may be several concentric liners, whereas, at lowermost depths there may be only a single bore liner (or none at all). Ordinarily, the annular regions between these liners is filled with cement (concrete).

Corrosion protection of the well bore liners is typically provided by a corrosion-resistant production pipe which is suspended from the wellhead inside the innermost liner. An inert gas, such as nitrogen, is typically introduced into the annular space between the production pipe and the innermost bore liner under sufficient pressure to maintain the space free of the geothermal brine down to a depth, for example, of about 1500 feet. In such circumstances, the brine is kept from contact with most of the liner pipe by the inert gas "plug".

If, however, the production pipe corrodes through in the region of the inert gas "plug," the gas will leak from the production pipe liner space and geothermal brine, by its natural pressure, will fill the space and will tend to cause rapid corrosion of the liner. Since down-hole brine pressure may be in excess of 1000 psig, when the innermost bore liner corrodes through, the brine may also be forced outwardly through the underlying cement and thus may attack the next-innermost liner. The brine may also be forced upwardly through the cement and so cause wellhead leakage. In cases of severe corrosion, wellhead integrity may be lost and the well-head may be blown off by the brine pressure. Because of various detrimental impurities in many geothermal brines, brine spillage caused by significant wellhead leakage or blown-off wellheads can result in very high clean up costs.

It can also be appreciated that the replacement of corroded production pipe and/or the relining of well bores is very costly, not only due to the cost of replacement pipe but also because of the cost of bringing in a drill rig required for the operation. The cost of replacing the production pipe in a typical brine extraction may, therefore, be as high as $250,000.

Although corrosion problems associated with above ground brine handling equipment downstream of the wellhead are usually less severe than down-hole corrosion problems, such corrosion is still often sufficiently severe to dictate the use of comparatively expensive, corrosion-resistant materials.

In attempts to find suitable high strength, corrosion-resistant materials, many different types of metal alloys, including chrome-moly alloys, nickel alloys, stainless steel alloys, and various titanium alloys have been tested in brine flows and/or have been experimentally used for the construction of brine production pipe or of test lengths thereof. Heretofore it has ordinarily been found that those alloys which provide good corrosion resistance either do not have, or do not retain, sufficient high temperature strength or cannot be economically used to construct pipe and related fittings and equipment in the desired large diameters and sizes enabling economical brine extraction rates.

Various nickel alloys, for example, appear to provide good resistance to brine corrosion but require cold working to achieve high strength. As a result, pipe and fittings larger than about 9–10 inches in diameter are extremely difficult and costly to produce from such alloys. As another example, highly pure (about 99.7 percent) titanium has been found to be resistant to corrosion by geothermal brine but does not provide needed high temperature strength. Chrome-moly alloys (for example, 9 chromium, 1 molybdenum) have, on the other hand, usually been found to provide good high temperature strength, but have also been found to be very poorly resistant to corrosion by typical geothermal brines.

More satisfactory alloys, in terms of corrosion resistance, high temperature strength and relative ease of fabricating large sizes of piping and equipment, are, therefore, needed for many geothermal brine extraction and handling systems in order to reduce system procurement and operating costs to an extent enabling the production of competitively priced electric power.

It is, therefore, an object of the present invention to provide a method for conducting a flow of corrosive geothermal brine (or of other geothermal fluid) which resists corrosion while at the same time providing good high temperature strength and ease in fabricating large size piping and equipment.

Another object of the present invention is to provide a method for conducting a flow of corrosive geothermal fluid in which a beta-alpha titanium-base alloy is used to construct piping and brine handling equipment.

Additional objects, advantages and features of the present invention will become apparent to those skilled in the art from the following description.

SUMMARY OF THE INVENTION

According to the present invention, a method is provided for resisting corrosion while conducting a flow of hot, corrosive geothermal fluid. As used herein, the term "geothermal fluid" is to be understood to mean only geothermal water or brine, geothermal steam or mixtures of water, brine and/or steam. The term geothermal fluid thus does not include other generally less usable geothermal liquids such as molten rock (lava) or other molten materials. The method of the present invention comprises flowing hot, corrosive, geothermal fluid through a fliud-conducting element formed of a beta and alpha titanium-base product formed by heating a composition (defined below) to form a metastable beta titanium matrix, and thereafter heat treating the matrix to form sufficient alpha phase therein causing the ultimate tensile strength to be increased by at least about 10,000 psi, and preferably about 30,000 psi over that of the pre-heat treated matrix, the beta and alpha titanium-base product so formed having an average valance electron density of between about 4.15 and about 4.35, the composition consisting essentially of a total of between about 2 and about 10 weight percent of one or more beta eutectoid elements selected from the group consisting of iron, cobalt, iron, manganeses, chromium and cobalt, the maximum weight percentages of iron, manganese, chromium and cobalt being, respectively, about 5, about 5.5, about 9 and about 4; between about 4 and about 10 weight percent of vanadium; between about 3 and about 6 weight percent of molybdenum; between about 2 and about 5 weight percent of aluminum; with the balance being titanium.

Preferably the heart treating of the matrix comprises rapid cooling from the beta range and thereafter aging the matrix at a temperature of between about 800° F. and about 1150° F. for a time sufficient to produce the 10,000 psi ultimate tensile strength increase. The matrix is preferably heat treated to an ultimate tensile strength of at least about 170,000 psi and more preferably to at least about 180,000 psi and most preferably to at least about 200,000 psi.

According to an embodiment, the titanium-base alloy is a metastable beta titanium base alloy comprising titanium, aluminum, vanadium, chromium, molybdenum, and may further comprise zirconium. The alloy may comprise a metastable beta titanium base alloy formed of about 2.0 to about 5.0 weight percent of aluminum, about 6.0 to about 10.0 weight percent of vanadium, about 3.0 to about 8.0 weight percent of chromium, about 3.0 to about 6.0 weight percent of molybdenum, less than about 5.0 weight percent of zirconium, and the remainder titanium.

More preferably, however, the metastable beta titanium-base alloy comprises about 3.0 to about 4.0 weight percent of aluminum, about 7.5 to about 8.5 weight percent of vanadium, about 5.5 to about 6.5 weight percent of chromium, about 3.5 to about 4.5 weight percent of molybdenum, about 3.5 to about 4.5 weight percent of zirconium, and titanium.

The geothermal fluid flowed through the fluid conducting element may be geothermal brine having a temperature of at least about 400° F. and a salinity of at least about 5 percent. The geothermal fluid may be extracted through a well-bore from an underground, geothermal formation, the step of forming a fluid conducting element then including forming a geothermal fluid production pipe and inserting the production pipe into the well-bore into proximity with the formation. Typically the fluid is geothermal brine having a formation pressure greater than about 100 psig, the formation temperature may be greater than about 500° F. and the brine may have a salinity of at least about 20 percent total dissolved solids.

DESCRIPTION OF THE PREFERRED EMBODIMENT

A specific type of metastable beta-titanium base alloy has now been discovered to have properties making the alloy very useful in applications involving hot, corrosive geothermal fluids, especially geothermal brine. Titanium-base alloy as used herein is to be understood to mean that titanium forms the major constituent of the alloy. Such alloy moreover has been discovered to be particularly useful for the fabrication of down-hole production pipe in geothermal brine extraction wells. The specific metastable beta titanium-base alloy which has now been discovered to be very useful for the above-mentioned applications is an alloy substantially as disclosed and claimed in U.S. Pat. No. 3,615,378 issued to Bomberger, et al, Oct. 26, 1971 and assigned to Reactive Metals, Inc., now the RMI Company, which is a co-assignee of the present invention, such patent being incorporated in its entirety by specific reference hereinto.

The metastable beta-titanium alloy disclosed in the Bomberger, et al patent can be generally characterized as a beta and alpha titanium-base product produced by heating a composition (defined below) to form a metastable beta titanium matrix and thereafter heat treating the matrix to form sufficient alpha phase therein to provide an increase in ultimate tensile strength of at least about 10,000 psi and preferably at least about 30,000 psi over that of the matrix before its heat treating. The beta and alpha titanium-base product so formed has an average valence electron density of between about 4.15 and about 4.35. The composition from which the beta and alpha titanium-base product is formed consists essentially of a total of between about 2 and about 10 weight percent of one or more beta eutectoid elements selected from the group consisting of iron, manganese, chromium and cobalt, except that the maximum allowable individual weight percentages of the iron, manganese, chromium and cobalt being respectively about 5, about 5.5, about 9 and about 4; between about 4 and about 10 weight percent of vanadium; between about 3 and about 6 weight percent of molybdenum; between about 2 and about 5 weight percent of aluminum with the balance being titanium.

Sufficient alpha phase to produce the desired increase in ultimate tensile strength may be achieved either by slowly cooling the matrix from the beta range or by rapidly cooling the matrix from the beta range followed by its temperate aging, for example, at a temperature in the range of between about 800° F. and about 1500° F. for a time sufficient to produce the desired ultimate strength increase. The matrix may be heat treated in such manner to an ultimate tensile strength of at least about 170,000 psi or more preferably at least about 180,000 psi and may in some cases be heat treated to at least about 200,000 psi ultimate tensile strength.

Such alloys as described above are particularly useful for aircraft and aerospace applications requiring high material strengths. Moreover, the titanium-base alloy covered is so formulated as to enable considerable forming into desired shapes, with after-forming heat treatment enabling high tensile strengths to be achieved. This heat treatability property of the subject alloy is in contrast to the properties, of, for example, nickel steels which achieve strength through work hardening of the products made therefrom.

The property of enabling extensive forming of the beta titanium-base alloy into desired shapes which can then be heat treated to high strengths is very important in that large diameter pipe and fittings, as well as other equipment requiring high strength, can thereby be produced. In contrast, nickel alloys requiring cold working (as by further forming or drawing) are limited in the size of products that can be produced because of the large size of the associated work hardening equipment.

Thus, as an example, the maximum diameter of high strength pipe which can currently be constructed from nickel alloys is believed to be about 9 inches with the associated pipe maximum length being about 21 feet. Work hardening of such size products requires massive and very expensive drawing equipment. On the other hand, high strength pipe in much larger diameters and lengths can be constructed from such alloys as the above-mentioned beta titanium-base alloy because the products are heat treated rather than cold worked to achieve high strength.

Also importantly, the subject beta titanium-base alloy has a high strength-to-weight ratio, being, for example, about 40 percent lighter than steel alloys. Having a high strength-to-weight ratio is very important in geothermal fluid production pipe which is suspended from the wellhead and which may hang to a depth of 6000–8000 feet. Considering that steel production pipe of about $9\frac{5}{8}$ inch O.D. may weigh about 60 pounds per foot, it is apparent that an 8000 foot steel production pipe string weighs on the order of a half-million pounds. Thus, weight alone tends to limit the size of steel alloy production pipe which can be used without exceeding the yield strength of the pipe.

As mentioned above, nearly pure titanium has been found to be corrosion resistant in geothermal brine environments, but has also been found not to have good high strength characteristics. Moreover, it has been the usual experience that as greater amounts of other metals are alloyed with titanium to increase the alloy's ultimate strength characteristics, the corrosion-resistance of the alloys has been found to decrease.

Accordingly, to the present inventors' knowledge, no titanium alloys have heretofore been identified as having the unexpected, combined properties of high-strength at elevated temperatures, high strength achieved through heat treating rather than by cold working and excellent resistance to all types of corrosion by geothermal fluids, particularly by hot geothermal brine which typically has reducing, rather than oxidizing, properties.

It is, therefore, considered very unexpected to find that the metastable beta titanium-base alloys similar to those covered by the Bomberger, et al patent and/or disclosed herein do, in fact, exhibit the above-mentioned combination of desirable characteristics.

The above-mentioned RMI Company (Niles, Ohio) produces a specific metastable beta titanium-base alloy in general accordance with the above-cited patent. Such alloy is commonly designated in the trade as "RMI 38644" and having the nominal composition (in weight percent) of 3 aluminum, 8 vanadium, 6 chromium, 4 molybdenum and 4 zirconium. The specified approximate ranges of the stated alloying additives (in weight percentages) of the RMI 38644 alloy are 3.0–4.0 aluminum, 7.5–8.5 vanadium, 5.5–6.5 chromium, and 3.5–4.5 molybdenum and 3.5–4.5 zirconium. It is considered, however, that additive ranges (in weight percentage) of about 2.0 to about 5.0 aluminum, about 6.0 to about 10.0 vanadium, about 3.0 to about 8.0 percent chromium, about 3.0 to about 6.0 percent molybdenum and between about 0.0 to about 5.0 percent of zirconium would also provide metastable beta titanium base alloys having the desirable combination of properties set forth above.

The present invention is further illustrated by the following Examples which are illustrative of various aspects of the invention and are not intended as limiting the scope of the invention as defined by the appended claims.

EXAMPLE 1

Three similar, two by four inch "coupons," each having a thickness of between about 1/16 to about ⅛ inches are constructed from each of the twenty different below-listed alloys having compositions as set forth in Table 1.

TABLE 1

| ALLOY | Cr | Ni | Mo | Fe | Cu | Other |
|---|---|---|---|---|---|---|
| Beta titanium (B-ti) (RMI 38644) | 6 | | 4 | | | Al −3, V −8, Zr −4 |
| Titanium, grade 2 (Ti 2) | | | | | | Commercially pure Ti |
| Titanium, grade 12 (Ti 12) | | 0.9 | 0.3 | | | Ti balance |
| HASTELLOY C-276 | 15 | Bal. | 16 | 6 | | Co −2.5, W −4 |
| HASTELLOY G-3 | 22 | Bal. | 7 | 19.5 | 2 | Co −5, W −1.5 |
| INCONEL 625 | 21.5 | Bal. | 9 | 2.5 | | Nb + TA −3.6 |
| Sumitomo (SM) 2550-110 | 24 | 50.5 | 6 | 17 | | Ti −1 |
| 904L | 19.5 | 27 | 4.5 | Bal. | | |
| AL6X | 20.5 | 24.5 | 6 | Bal. | | |
| Sumitomo (SM) 825-110 | 21 | 45 | 3 | 27 | 2.5 | Ti −1 |
| INCOLOY 825 | 22.5 | 42 | 3 | 39 | 2 | Ti −1 |
| 254 SMO | 20.5 | 18 | 6 | Bal. | | N −.22 |
| SANICRO 28 | 27 | 31 | 3.5 | Bal. | 1 | |
| Sumitomo (SM) 2035-110 | 22 | 36 | 4.5 | 35 | | |
| FERRALIUM (F) 255 | 26 | 6 | 3 | Bal. | 2 | |
| Sumitomo (SM) 25 Cr | 25 | 7 | 3 | Bal. | | |
| 22 Cr DUPLEX-125 | 23.5 | 5.5 | 3 | Bal. | | |
| 22 Cr DUPLEX-65 | | | | | | |
| Type 316 stainless steel | 17 | 12 | 2.5 | Bal. | | |
| 9 Cr, 1 Mo | 9 | | 1 | Bal. | | |

A geothermal brine extraction well is selected as a coupon test site, the well selected having a depth of about 3000 feet, having a production pipe of about 8⅝ inches in diameter and having a production flow rate of about 600,000 pounds of brine per hour. Composition of the brine, as is considered to affect its corrosiveness, is approximately as shown below in Table 2 with other impurities not considered to affect corrosiveness being also present in various amounts.

TABLE 2

| | |
|---|---|
| Total Dissolved Solids | 23.9% |
| Chloride | 12.6% |
| Sodium | 6.0% |
| Potassium | 1.3% |
| Calcium | 2.4% |

TABLE 2-continued

| | |
|---|---|
| Manganese | 785 ppm |
| Iron | 700 ppm |
| Ammonia | 360 ppm |
| Carbon Dioxide | 125 ppm |
| Hydrogen Sulfide | 90 ppm |

One coupon of each alloy type listed in Table 1 is suspended in the brine flow at a depth of about 1858 feet, another coupon of each alloy type is suspended in the brine flow near the top of the well (at a depth of about 451 feet) and the third coupon of each alloy type is installed in the brine flow in the wellhead brine conduit on the surface of the ground. Brine temperature in the three test regions is about 507° F. at 1858 feet, about 465° F. at 451 feet and about 430° F. at the wellhead. Additional, U-bend coupons are formed from a number of the alloys and are installed at the same depths and for the same time durations as are the flat coupons. Dynamic brine pressure at the 1858 foot depth is approximately 700–750 psig, the static pressure being about 800–850 psig at such depth. Dynamic wellhead pressure is approximately 350 to 460 psig. Static reservoir pressure is about 1300 psig.

After being exposed to brine flow for about 4008 hours, the test coupons are removed and examined for evidence of uniform corrosion, of pitting corrosion, and of crevice corrosion, the latter being the type of corrosion found, for example, under washers and fasteners and being generally the most severe type of corrosion experienced. The amount of corrosion measured is expressed in terms of mil per year (mpy) and the results are shown in Table 3 below.

TABLE 3

| | CORROSION TYPE | | | | | | | | |
|---|---|---|---|---|---|---|---|---|---|
| | Uniform - mpy | | | Pitting - mpy | | | Crevice - mpy | | |
| | (1) | (2) | (3) | (1) | (2) | (3) | (1) | (2) | (3) |
| B-Ti | .05 | 0 | .02 | 0 | 0 | 0 | 4 | 0 | 0 |
| Ti-2 | .09 | .03 | .05 | 4 | 0 | 0 | 8 | 15 | 1 |
| Ti-12 | .05 | .01 | .06 | 9 | 0 | 0 | 3 | 0 | 0 |
| HASTALLOY C-276 | .07 | .04 | .02 | 0 | 0 | 0 | 3 | 0 | 0 |
| HALTALLOY G-3 | .05 | .03 | .01 | 18 | 3 | 0 | 21 | 6 | 0 |
| INCONEL 625 | | .04 | .02 | 0* | 0 | 0 | 12* | 0 | 0 |

TABLE 3-continued

| | CORROSION TYPE | | | | | | | | |
|---|---|---|---|---|---|---|---|---|---|
| | Uniform - mpy | | | Pitting - mpy | | | Crevice - mpy | | |
| | (1) | (2) | (3) | (1) | (2) | (3) | (1) | (2) | (3) |
| SM 2550-110 | | .03 | .03 | 15* | 4 | 0 | 4* | 2 | 0 |
| 904L | | .04 | .03 | 20* | 8 | 1 | 17* | 4 | 4 |
| AL6X | | .03 | .03 | 19* | 2 | 2 | 10* | 6 | 0 |
| SM 825-110 | | .05 | .03 | 12* | 8 | 0 | 12* | 7 | 0 |
| INCOLOY 825 | | .03 | .02 | 20* | 10 | 0 | 12* | 9 | 0 |
| 254 SMO | | .02 | .02 | 17* | 4 | 0 | 4 | 8 | 0 |
| SANICRO 28 | | .03 | .01 | 20* | 12 | 2 | 20* | 8 | 0 |
| SM 2035-110 | .07 | .04 | .04 | 20 | 8 | 0 | 28 | 6 | 8 |
| F-255 | .09 | .03 | .02 | 22 | 2 | 0 | 32 | 0 | 0 |
| SM 25 Cr | .15 | .03 | .02 | 11 | 2 | 2 | 45 | 20 | 0 |
| 22 Cr DUPLEX-65 | .20 | .04 | .02 | 16 | 10 | 0 | 38 | 11 | 8 |
| 22 Cr DUPLEX 125 | .20 | .04 | .02 | 8 | 12 | 0 | 64 | 20 | 12 |
| Type 316 stainless steel | | .11 | .04 | 19* | 14 | 0 | 16* | 20 | 0 |
| 9 Cr 1 Mo | | 4.8 | 1.9 | ** | ** | 92 | ** | ** | 8 |

(1) 1858 ft.
(2) 451 ft
(3) at surface
*measured on U-bend coupons
**coupon perforated

EXAMPLE 2

A section of test pipe is constructed from type RMI 38644 metastable beta titanium base alloy. The outside diameter of the pipe is about 8⅝ inches, the wall thickness is about 0.5 inches and the length is about 19 feet. About an 18 inch long section is cut from the pipe to be retained as a control specimen.

The remaining length of pipe is visually examined for evidence of pitting or the like and is installed in a production pipe string. The pipe string is suspended as a production pipe in a geothermal brine extraction well having brine characteristics as above-described in EXAMPLE 1. When so installed in the brine extraction well, the section of metastable Beta titanium-base alloy is suspended at a depth of about 1750 feet at which the brine temperature is about 500° F. Brine is flowed at an average rate of about 672,000 pounds per hour through the production pipe, including the above-described test section for about 220 day. In all, however, the test section is suspended in the extraction well in contact with the brine for a total duration of about 256 days.

The production pipe is then withdrawn from the brine extraction well and the test section is removed and again visually examined. No evidence of general, crevice or pitting corrosion is seen.

The test section of pipe and the short portion previously cut therefrom are then strength tested in accordance with the standard test procedures set forth in ASTM B-337-83 for seamless and welded titanium pipe, with no substantial degradation of properties being found in the brine-exposed test section, the results of the testing being shown below in Table 4.

TABLE 4

| Parameter | Unexposed, short portion | Brine exposed test section |
|---|---|---|
| Ultimate Strength | 181.3–183.3 KSI | 175.0–183.4 KSI |
| Yield Strength | 174.0–181.3 KSI | 161.8–167.0 KSI |
| Percent Elongation | 7.0–8.0 | 8.0–11.0 |

Hydrogen pickup which provides some indication of corrosion and of which may be an indication of hydrogen embrittlement is measured (by chemical analysis) on both the unexposed portion of pipe and the brine-exposed test section and is found in both specimens to be less than about 0.02 percent, indicating only minimal hydrogen pickup.

Although a particular embodiment of the present invention has been described, it will, of course, be understood that the invention is not limited thereto, since many obvious modifications can be made, and it is intended to include within this invention any such modifications as fall within the scope of the appended claims.

What is claimed is:

1. A method for resisting corrosion while conducting a flow of hot, corrosive geothermal fluid, the method comprising the steps of:

(a) forming a fluid conducting element of a beta and alpha titanium-base product produced by heating to form a metastable beta titanium matrix, and thereafter head treating said matrix to form sufficient alpha phase therein providing an increase in ultimate tensile strength of at least about 10,000 psi over that of the matrix before said heat treating, said beta and alpha titanium-base product so formed having an average valence electron density of between about 4.15 and about 4.35, said composition consisting essentially of:

(i) a total of between about 2 and about 10 weight percent of one or more beta eutectoid elements, selected from the group consisting of iron, manganese, chromium and cobalt, except that the maximum individual weight percent of iron is about 5 percent, of manganese is about 5.5 percent, of chromium is about 9 percent, and of cobalt is about 4 percent:

(ii) between about 4 and about 10 weight percent of vanadium;

(iii) between about 3 and about 6 weight percent of molybdenum;

(iv) between aout 2 and about 5 weight percent of aluminum; and (v) the balance titanium; and (b) flowing said geothermal fluid through said fluid conducting element.

2. The method as claimed in claim 1 including the step of heat treating said matrix to provide an increase in ultimate strength of at least about 30,000 psi.

3. The method as claimed in claim 1 wherein said heat treating of the matrix comprises rapid cooling from the beta range and thereafter aging the matrix at a temperature of between about 800° F. to about 1150° F. for a time sufficient to produce said at least 10,000 psi ultimate tensile strength increase.

4. The method as claimed in claim 1 wherein the matrix is heat treated to an ultimate tensile strength of at least about 170,000 psi.

5. The method as claimed in claim 4 wherein the ultimate tensile strength is at least about 200,000 psi.

6. A method for reducing corrosion while conducting a flow of hot, corrosive geothermal fluid, comprising:

(a) forming a fluid-conducting element of a metastable beta titanium base alloy consisting essentially of:

(i) about 2.0 to about 5.0 weight percent of aluminum;

(ii) about 6.0 to about 10.0 weight percent of vanadium;

(iii) about 3.0 to about 8.0 weight percent of chromium;

(iv) about 3.0 to about 6.0 weight percent of molybdenum;

(v) about 0.0 to about 5.0 weight percent of zirconium; and (vi) the balance titanium; and (b) flowing said geothermal fluid through said fluid-conducting element.

7. The method as claimed in claim 6 wherein the metastable beta titanium-base alloy consists essentially of:

(a) about 3.0 to about 4.0 weight percent of aluminum, (b) about 7.5 to about 8.5 weight percent of vanadium, (c) about 5.5 to about 6.5 weight percent of chromium, (d) about 3.5 to about 4.5 weight percent of molybdenum, (e) about 3.5 to about 4.5 weight percent of zirconium, and (f) the balance titanium.

8. The method as claimed in claim 6 including the step of heat treating the fluid-conducting element to a tensile strength of at least about 180,000 psi.

9. The method as claimed in claim 8 wherein the tensile strength is at least about 200,000 psi.

10. The method as claimed in claims 1 or 6 wherein the geothermal fluid comprises geothermal brine having a temperature of at least about 400° F. and a salinity of at least about 5 percent.

11. The method as claimed in claims 1 or 6 wherein the method comprises extracting a geothermal fluid through a well-bore from an underground, geothermal fluid-containing formation, and wherein the step of forming a fluid conducting element includes forming a geothermal fluid production pipe and including the step of inserting said production pipe into said well-bore into proximity with said formation.

12. The method as claimed in claim 11 wherein the geothermal fluid is geothermal brine having a formation pressure greater than about 1000 psig.

13. The method as claimed in claim 12 wherein the geothermal brine has a formation temperature greater than about 500°. F.

14. The method as claimed in claim 12 wherein the geothermal brine has a salinity of at least about 20 percent total dissolved solids.

* * * * *